US007069750B1

(12) United States Patent
Chang

(10) Patent No.: US 7,069,750 B1
(45) Date of Patent: Jul. 4, 2006

(54) METHOD FOR WEAVING AN EDGING ORNAMENT WITH PLASTIC ROPE

(76) Inventor: Ming-Che Chang, 1F., No. 17, Ruelyang St., Changhua City, Changhua County 500 (TW)

( * ) Notice: Subject to any disclaimer, the term of this patent is extended or adjusted under 35 U.S.C. 154(b) by 0 days.

(21) Appl. No.: 11/184,885

(22) Filed: Jul. 20, 2005

(51) Int. Cl.
*D04B 23/12* (2006.01)

(52) U.S. Cl. ..... 66/193

(58) Field of Classification Search ..... 66/195, 66/190, 191, 192, 169 R, 170, 193
See application file for complete search history.

(56) References Cited

U.S. PATENT DOCUMENTS 4,183,993 A * 1/1980 Benstead et al. ..... 66/190
4,425,398 A * 1/1984 Berczi ..... 66/193
4,632,863 A * 12/1986 Henningsson ..... 66/192
5,164,250 A * 11/1992 Paz Rodriguez ..... 442/186
5,728,448 A * 3/1998 Okeya et al. ..... 66/193

* cited by examiner

*Primary Examiner*—Danny Worrell
(74) *Attorney, Agent, or Firm*—Troxell Law Office, PLLC

(57) ABSTRACT

A method for weaving an edging ornament with a plastic rope. The flat plastic rope is fed continuously into a latitudinal feed unit of a crochet machine to continuously provide a coiled latitudinal course with a fixed width. The crocheting a latitudinal wale in a short segment on each two edges of the latitudinal course with several parallel longitudinal crocheting units to form a continuous latitudinal webbing coiled arrangement. Since the two edges are woven by longitudinal wale, there will be no loose strips of knitted webbing. Two edges of one end are woven tightly by the wale, the side segment forms an edging ornament by cutting a middle section of the knitted webbing.

2 Claims, 3 Drawing Sheets

FIG. 1-A

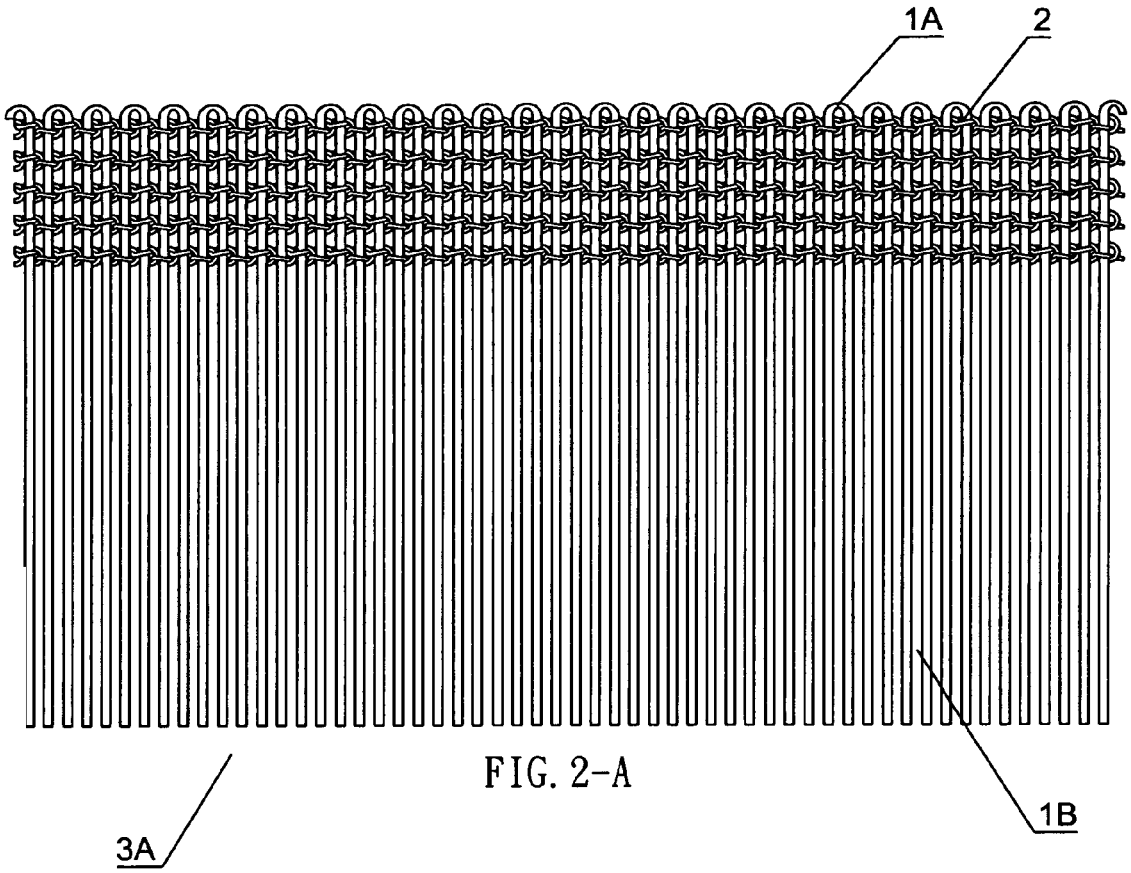
FIG. 2-A
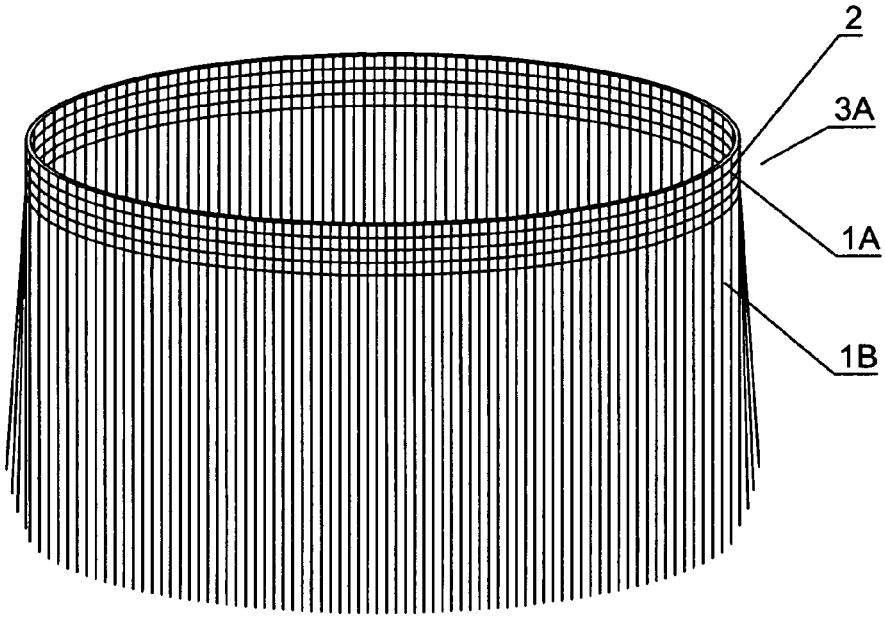
FIG. 2-B

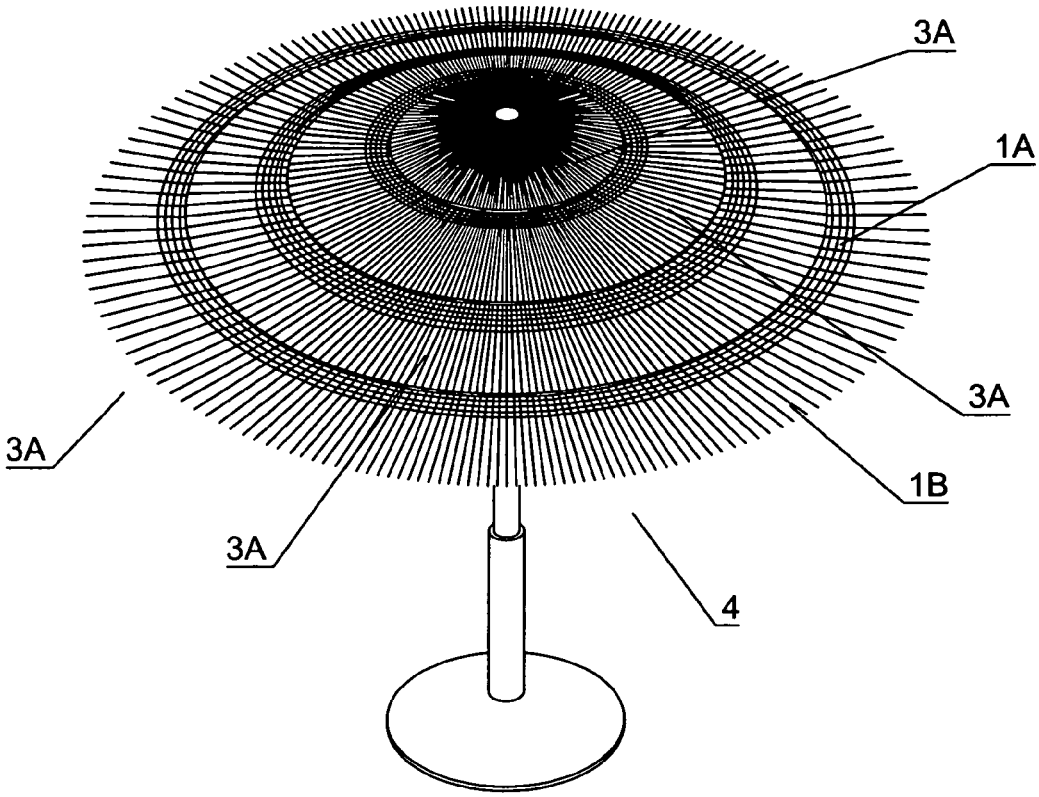
FIG. 3-A
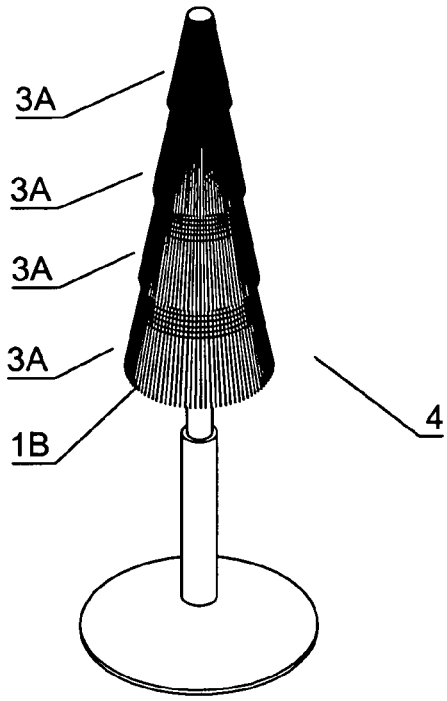
FIG. 3-B

METHOD FOR WEAVING AN EDGING ORNAMENT WITH PLASTIC ROPE

BACKGROUND OF THE INVENTION

1. Field of the Invention

This invention is a method of feeding a flat plastic rope continuously into a latitudinal feed unit of a crochet machine to produce a coiled latitudinal course having a fixed width in succession, then crocheting a longitudinal wale in a short segment position of two sides of the latitudinal course with several parallel longitudinal crocheting units. Two edging ornaments can be formed each edging ornament having one end woven tightly by the wale, but cutting the knitted webbing at a middle section of the knitted webbing.

2. Description of the Prior Art

The traditional edging ornament or edging umbrella uses straight herbage plant as raw material, woven by manpower and fixed it on the bamboo support. However, either its selection of raw material or weaving edging, may waste time & workload, its cost is also very high.

However, th past improved method, though it replaced the strip raw material of edging ornament with plastic tope, its leveling off and fixing still relies on manpower, some plastic ropes cannot be leveled off and paralleled accordingly, furthermore, its manufacturing speed is slow and production cost is also very high.

Thereby, inventor of this case has developed this method and device to weave edging ornament with plastic rope (application Ser. No. 10/187,611; U.S. Pat. No. 6,817,384). This case uses plastic rope with selected color to weave the plastic rope as cloth by plain weave of loom and the distance between weaving segments is confirmed in accordance with the required weave length; then cut off near one side of woven segment, so that each unit of the plastic knitted webbing has the cut remaining lines and edging segment at two sides of the woven segment, again heat the cut remaining lines with a heating device at least once beneath the knitted webbing, so the cut remaining lines may be fused mutually and fixed, based on these steps, the edging ornament is made accordingly.

Of course, this U.S. Ser. No. 10/187,611 patent case can replace most of the manpower to pack up strip raw material and also be economical, however, it demands one heating device to fuse and fix the cut remaining lines, except the disadvantage of processing procedure and increase of cost, the problem mainly is the operational result of fusing by heating since it cannot ensure each cut remaining line can be tightly fused as required. When the cut remaining lines are palletized too high and there is less temperature or torn by strong force, its unwoven and packed single line may drop off from the fused point so that the cut remaining lines around there may be dropping, the appearance of product may be damaged or lose function, therefore, it is earnestly required to get improved.

Due to the disadvantage existed in his former patent, the inventor has made an improved facture described in this invention, in which:

SUMMARY OF THE INVENTION

The key purpose of this invention is to provide an improved facture to weave edging ornament with plastic rope; in which, the flat plastic rope is fed continuously into the latitudinal feed unit by crochet machine so that it can provide the coiled latitudinal course in fixed width in succession, then weave longitude wale in the short position of two sides of latitudinal course with several parallel longitude crocheting units; each course is woven by wale so as to make a tightly tied medium loose strip knitted webbing; Cutting off the knitted webbing at its medium segment can make two edging ornaments that won produce virtual edge, which can bear tearing of outside force so as to improve durability of product, it is also the best way to stabilize quality of the product.

The second purpose of this invention is to provide an improved facture to weave edging ornament with plastic rope; in which, the integrative woven medium loose strip knitted webbing is not required to fuse the cut remaining lines by heating device so that this facture may decrease processing procedure and reduce cost.

BRIEF DESCRIPTION OF THE DRAWINGS

FIG. 1-A is an enlargement of area A of implemented crochet with longitude wale and latitudinal course.

FIG. 2-A is the knitted webbing positioned vertically.

FIG. 2-B is a perspective view of the knitted webbing coiled into a ringed and vertical edging.

FIG. 3-A is a perspective view of an opened knitted webbing of an edging umbrella.

FIG. 3-B is a perspective view of a closed knitted webbing of the edging umbrella.

DETAILED DESCRIPTION OF THE PREFERRED EMBODIMENTS

Figure 1:
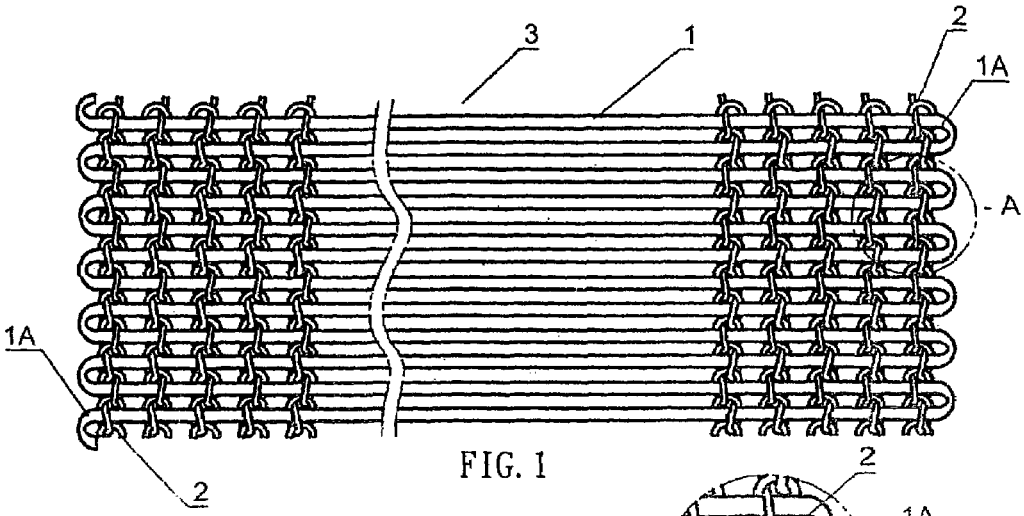
FIG. 1 is the latitudinal course and longitude wale collocating sketch map of knitted webbing of this invention.

The detailed contents and operations of this invention are described as follows:

As shown in FIG. 1, this invention utilizes a flat plastic rope 1 and a longitude plied yarn 2 as a color layout of a woven ornament.

Figure 2:
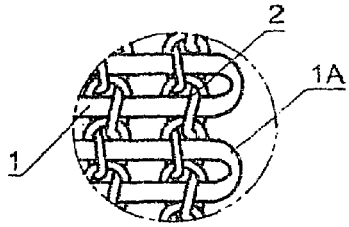
FIG. 2 is the latitudinal course and longitude wale of the knitted webbing.
Figure 2:
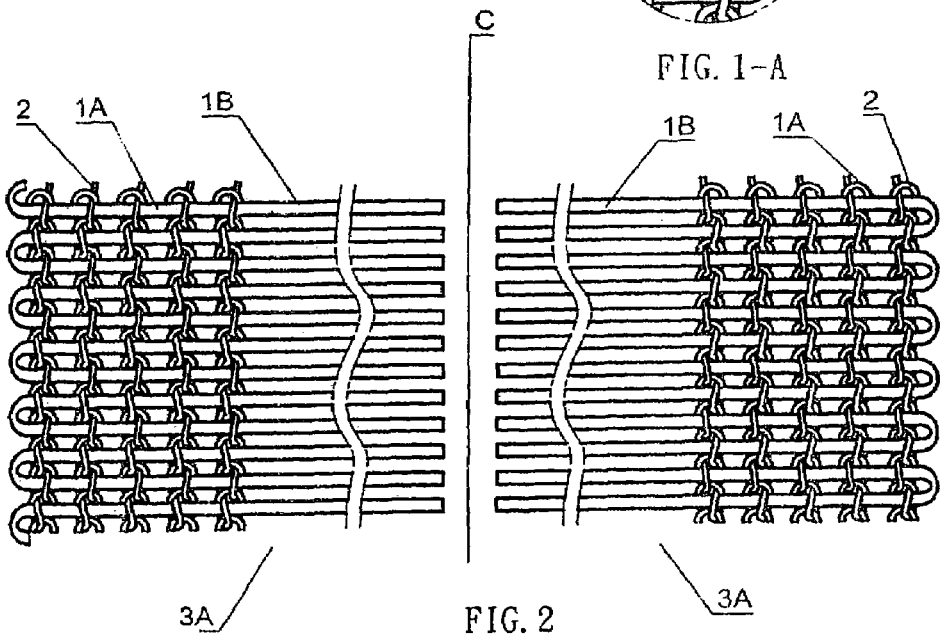

As shown in FIGS. 1–2, the flat plastic rope 1 is located in the latitudinal feed unit (not shown) of a crochet machine so that it can provide the coiled latitudinal course 1A in fixed width in succession, then crocheting the longitudinal wale in the short segment position of two sides of latitudinal course 1A with several parallel longitudinal crocheting units (not shown) so as to make the continuous latitudinal knitted webbing 1A in coiled arrangement. Meanwhile, weaving the two edges with several longitudinal wale 2 so that the loose flat knitted webbing 3 with close edges and without a virtual edge is woven accordingly.

As shown in FIG. 2, it is quick and easy to make edging 1B of an ornament 3A wherein one terminal is fixed by the wale and the side segment forms flapping edging 1B of the ornament 3A by cutting a middle segment (cutting direction is indicated as C) in a longitudinal direction (vertical) of the knitted webbing. A length of the two edging 1B can be moved to left or right in latitudinal direction (parallel direction) via the cut line C so that length of edging 1B can be either the same or different.

As shown in FIG. 2-A, by rotating ornament 3A in the edging 1B flapping with wind may be arranged in vertical downward position. As shown in FIG. 2-B, when the ornament 3A rotated in is coiled in ring, the ring edging 1B flapping with wind can be arranged in a vertical downward position.

In FIGS. 3-A and 3-B, the ornament 3A can mutually be palletized or combined with umbrella cloth of umbrella. The palletized or combined ornament 3A is sewn in umbrella cloth, the edging umbrella 4 that has continuous palletizing appearance and can be drawn back as the umbrella will be made as the above described former patent case (application Ser. No. 10/187,611; U.S. Pat. No. 6,817,384).

However, the ornament 3A made according to this invention has the following advantages that may not appear to have a virtual edge and also is easy to make the second processing and fixing of edging 1B. In addition, the short segment of the ornament 3A is the course 1A, which is woven by wale 2 so that it is bound tightly. Therefore, each edging 1B can bear an outside force and it is not easy to drop off, based on this, the durability and quality of ornament 3A is improved.

In summary, this invention can provide improved efficiency such as high speed production, stable quality, simple processing and reduction of cost, which has inventiveness and practicality.

What is claimed is:

1. A method for weaving an edging ornament with a plastic rope, which comprises the steps of:

a) selecting a latitudinal flat plastic rope and a longitudinal rope having a predetermined color for a woven ornament;

b) continuously feeding the latitudinal flat plastic rope into a latitudinal feeding unit of a crochet machine and forming a coiled latitudinal course having a predetermined width;

c) crocheting a longitudinal wale utilizing the longitudinal rope on each of two opposing ends of the coiled latitudinal course, each longitudinal wale having a plurality of parallel longitudinal crocheting units forming a continuous webbing; and d) cutting the continuous webbing along a dividing line in a middle portion thereof and forming two woven ornaments, each of the two woven ornaments having one longitudinal wale on a first end and unobstructed ends of the latitudinal flat plastic rope on a second end, wherein each of the two woven ornaments is made of a plant material and utilized as an edging for a device selected from the group consisting of an umbrella and a sun-protecting structure.

2. The method according to claim 1, wherein in the cutting step d) the dividing line is located a predetermined distance between the two opposing ends of the coiled latitudinal course, the predetermined distance is selected from a group of distances consisting of an equal distance and an unequal distance.

* * * * *